United States Patent [19]

Rangan

[11] 4,194,631

[45] Mar. 25, 1980

[54] MACHINE SORTABLE MAILING ENVELOPE

[76] Inventor: Karur S. Rangan, 36 Aberfeldy Crescent, Thornhill, Ontario, Canada

[21] Appl. No.: 949,073

[22] Filed: Oct. 6, 1978

[51] Int. Cl.[2] ..... B65D 27/06; B65D 27/34

[52] U.S. Cl. ..... 206/610; 206/632; 206/804; 229/73

[58] Field of Search ..... 229/73; 206/610, 804, 206/632

[56] References Cited

U.S. PATENT DOCUMENTS

| | | | |
|---|---|---|---|
| 1,145,935 | 7/1915 | Steinke | 229/73 |
| 1,870,908 | 8/1932 | Hahn | 206/605 |
| 1,888,313 | 11/1932 | Fiorenza | 206/610 |
| 2,332,751 | 10/1943 | Powell | 229/73 |
| 2,828,065 | 3/1958 | Heywood | 206/610 |
| 2,931,559 | 4/1960 | Hilliard | 229/73 |
| 3,270,948 | 9/1966 | Donovan | 229/73 |
| 3,558,040 | 1/1971 | Krueger | 229/73 |
| 3,652,008 | 3/1972 | Grotefend | 206/610 |

*Primary Examiner*—Stephen P. Garbe

*Attorney, Agent, or Firm*—George A. Rolston; William F. Frank

[57] ABSTRACT

An envelope suitable for machine sorting equipment, the envelope being adapted to be used twice, once on an outward trip, and once on a return trip when the envelope is returned to the original sender and having front and back panels and two closure flaps namely an outward trip closure flap and a return trip closure flap, the return trip closure flap being concealed within the envelope during the outward trip, and being capable of being extracted from the interior of the envelope to reseal the envelope for its return trip, the outward closure flap and part of the front panel being removed from the envelope prior to the return, and the front panel having a perforation line whereby both the outward trip closure flap and part of the front panel may be removed when it is torn off, to open the envelope. The return trip flap then folds out and covers the gap in the front panel.

7 Claims, 9 Drawing Figures

34
22
22b
18
30
14b
10b
14
12
35
20
12a
33
16
10
20

18
34
36
22
33

14
10
12

14
10
7

22
12
7
18
36
38
14

12
10
14
8
34
36
18

8
10
12
22
30
33

MACHINE SORTABLE MAILING ENVELOPE

The present invention relates to a mailing envelope suitable for use in machine sorting equipment, the envelope being adapted to be used twice, ie. both for an outward and a return mailing, such as may be used for mailing an invoice and the return mailing of a payment, and incorporating means for covering up the postal coding applied to the envelope during the outward mailing.

Many institutions, utilities and businesses are engaged in mailing out large quantities of mailing pieces requiring a reply such as for example oil companies, phone companies, credit card agencies, utilities, charities and the like. In this type of mailing, an envelope is mailed out to a customer, or a prospective donor, containing a computerized invoice and a return envelope. Upon receipt of the envelope, the customer or donor will make out a cheque for the amount shown in the invoice card, and may tear off a portion of the card, as a receipt, or for their records, and will then mail back a portion of the card together with the cheque in the return envelope.

The great majority of such agencies and credit card companies and the like operating today employ two envelopes. One envelope is used for the outward journey, and a somewhat smaller envelope is used for the return journey. The smaller envelope is specially designed and dimensioned to fit within the larger envelope, and at the same time to receive the cheque and the portion of the invoice card which is to be returned. Usually, the return envelope will be already preprinted with the address of the company or agency, and in some cases, will be franked with sufficient postage so as to avoid the need for the customer to apply a stamp. Similar procedures are used by utilities, gasoline companies, finance companies, banks and the like.

The cost of the envelopes and material used in such mailings is quite considerable and represents a substantial proportion of the total cost which must be borne by the agency. Any savings in the cost of such mailings is therefore highly desirable.

However, in spite of many different proposals for a single, round trip envelope, the practice in this type of business is still to use two separate envelopes, and the various different earlier proposals have not found any wide degree of acceptance. This is due partly because such earlier proposals were somewhat complicated and involved the manipulation of the envelope in a series of steps, by the customer, in a manner which was relatively difficult and the instructions for the use of the envelope by the customer were not easy to follow.

A further factor was the cost of the round trip envelope which, due to the excessive amount of paper employed, was very close the cost of the manufacturing of two conventional envelopes.

In particular, prior art round trip envelopes usually consisted essentially of two envelopes made as one, there being essentially four panels to such an envelope. As a result, there was little or no economy as compared with the manufacture of two separate envelopes which would essentially also require about four panels of paper. Furthermore it is now essential that the postal coding applied on the outward trip shall be covered up on the return trip.

In addition, such envelopes usually resulted in tags, glue patches or loose edges being left on the envelope which interfered with machine sorting equipment, on the return trip.

It is therefore a general objective of the present invention to provide a round trip envelope, suitable for use in machine sorting equipment having front and back panels, and two closure flaps for the envelope, namely an outward trip closure flap and a return trip closure flap, the outward closure flap being attached to the front panel and the return flap being attached to the back panel and being contained within the envelope during the outward trip, and being adapted to be extracted from the interior of the envelope by the customer and used for resealing the envelope for the return trip, and the front panel incorporating a perforation line by means of which a portion of the front panel and the outward trip closure flap may be removed when the envelope is torn open by the customer, the return closure flap being large enough to cover the gap in the front panel, and re-seal the envelope.

Preferably, the perforation lines consist of a continuous D-shaped line, for separating the central upper part of the front panel.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
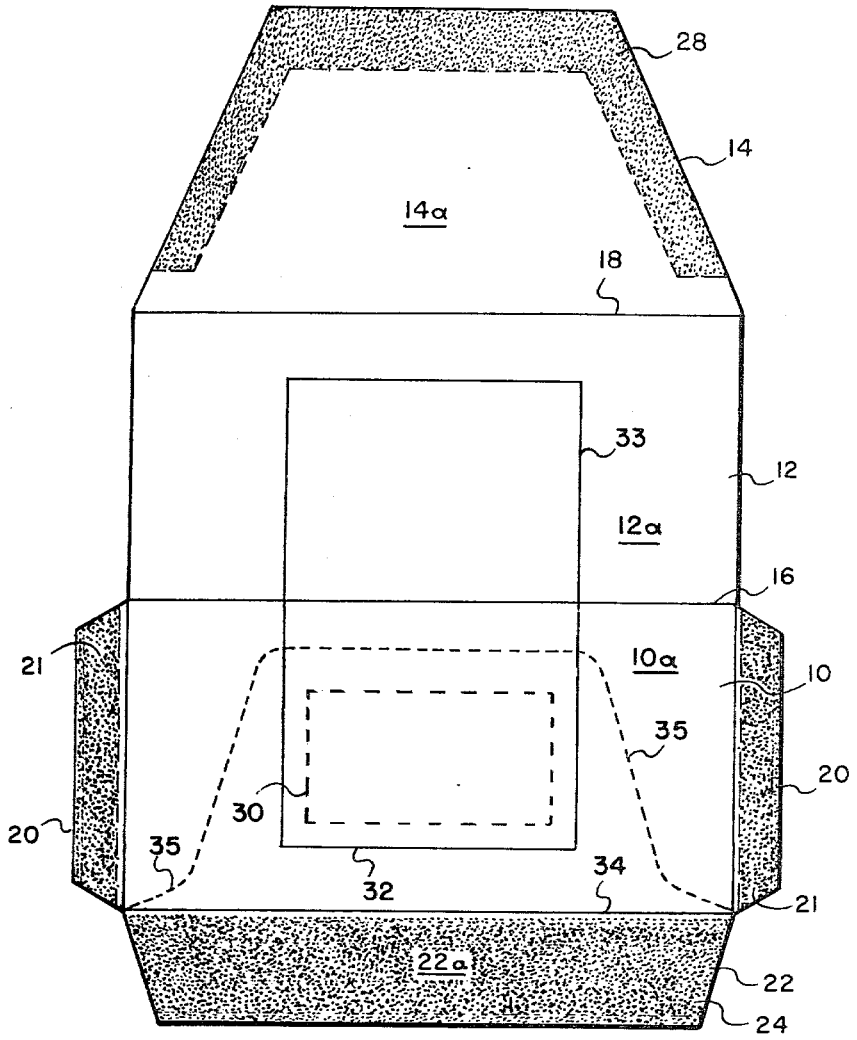
FIG. 1 is a plan view of a blank of paper cut out and indented, and coated with glue strips at the appropriate locations, for making the envelope according to the invention.
Figures 2, 3, 4, 5, 6, 7, 8, 9:
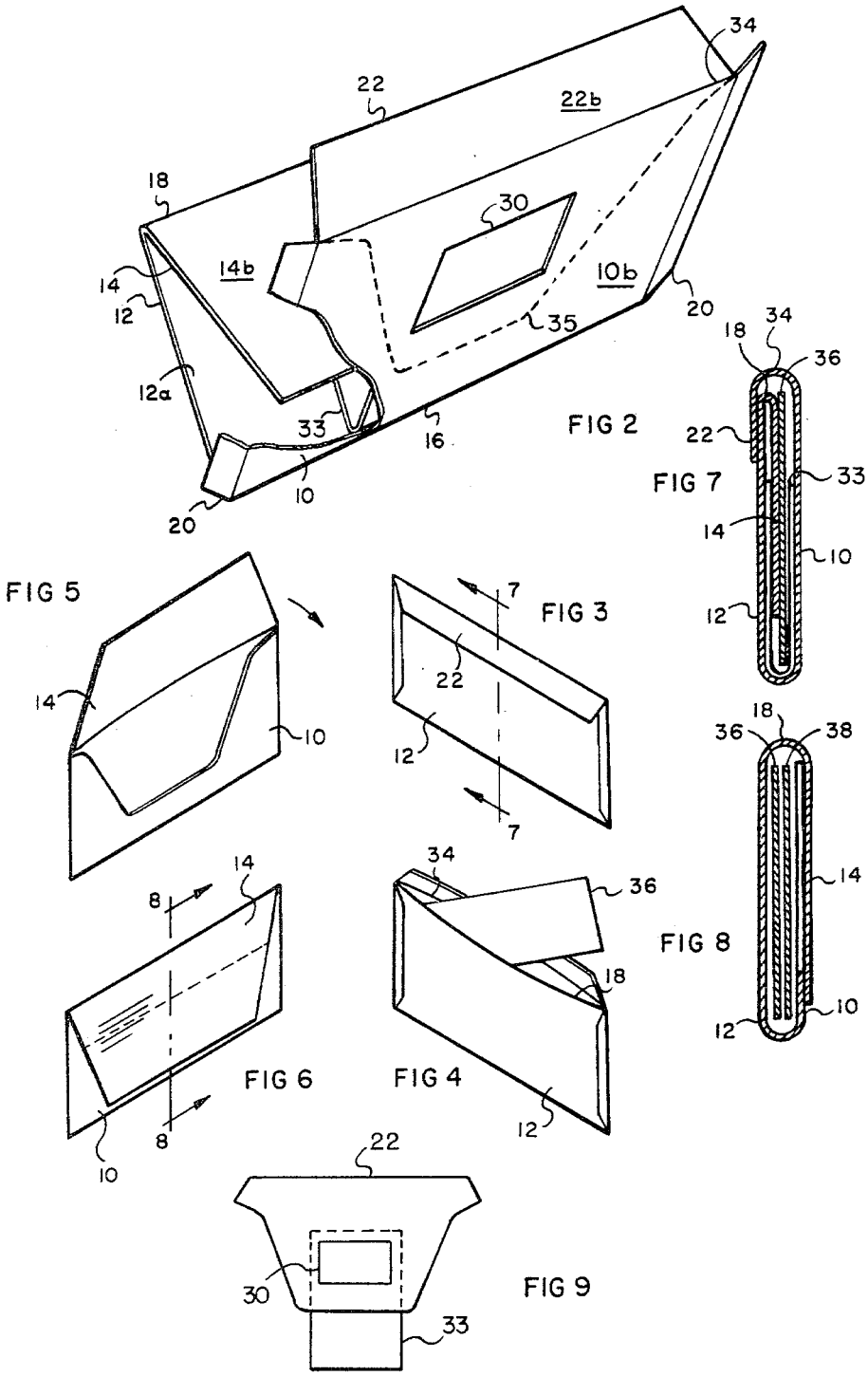
FIG. 2 is a perspective illustration showing the blank of FIG. 1 in the process of being folded up to make the envelope according to the invention.
FIG. 3 is a rear perspective illustration of the envelope according to the invention shown sealed for the outward mailing.
FIG. 4 is a perspective illustration of the envelope of FIG. 3 shown after it has been opened by the customer, and showing the contents being partially removed.
FIG. 5 is a front perspective of the envelope being prepared for the return trip.
FIG. 6 is a front perspective of the envelope shown sealed and ready for mailing on the return trip.
FIG. 7 is a section along the line 7—7 of FIG. 3 showing the envelope ready for its outward mailing.
FIG. 8 is a section along the line 8—8 of FIG. 6 showing the envelope sealed up ready for its return mailing.
FIG. 9 is a plan of the tear-off portion.

Referring to FIGS. 1 and 2, the envelope according to the invention will be seen to comprise three main panels namely a front panel 10, a back panel 12, and a return trip closure panel 14. The panels 10 and 12 are joined along a common fold line 16, and the panels 12 and 14 are joined along a common fold line 18. As shown in FIG. 1, the surfaces 10*a*, 12*a* and 14*a* of the panels 10, 12 and 14 are all interior surfaces, that is to say they are surfaces of the panel which will be located within the interior of the envelope, or will in any event be turned inwardly and concealed from view. Surfaces 10*b*, etc. are exterior surfaces. Return panel 14 is trapezoidal in shape as described below.

In order to form the panels into an envelope, a pair of side edge closing strips 20 are provided, which may preferably be attached on either side of the front panel 10 as shown but which may equally well be attached to the back panel 12 if desired. The edge strips 20 are preferably coated with a suitable glue or adhesive 21.

In order to close the envelope for its outward or first trip, outward trip closure flap 22 is provided attached to the free edge of the front panel 10. On the inwardly directed surface 22*a* of the flap 22 there is provided a glue strip 24 which will be of the pressure-sensitive type of adhesive. In this way when the envelope is opened by the addressee, the entire closure flap 22 can be removed, as described below, thereby avoiding interference with automatic sorting machinery on the return trip.

The glue strip 24 is relatively wide, and may cover the entire extent of flap 22, or may consist of parallel narrower strips (not shown) for example along the upper and lower edges (and along the centre) of the flap 22, or four strips arranged around all four edges of flap 24.

The inwardly directed face 14*a* of the return trip closure panel 14 is provided with a glue strip 28, preferably being of the type of adhesive conventionally used for sealing envelopes ie. of the liquid-activated type, although again various different adhesives may be used.

A window opening 30 is cut through the front panel 10 in a conventional manner covered with any suitable transparent panel 32.

The panel 32 has a panel extension flap 33, extending downwardly therefrom, which is folded along a fold line which will coincide with the fold line 16 at the bottom edge of the envelope.

The extension 33 assists in opening the envelope and removing the return flap 14.

A generally D-shaped perforation line 35 extends from near the upper corners of panel 10 downwardly around window 30, defining a tear-off or discarded portion consisting of the closure panel 22, the upper part of panel 10, and window panel 32, all of which can be removed, for remailing.

As shown in FIG. 2, the envelope blank of FIG. 1 is formed into an envelope by folding the return trip closure panel 14 along fold line 19, and then infolding it over the inwardly directed face 12*a* of the back panel 12, such fold being made along the fold line 18.

The front and back panels 10 and 12 are then infolded against one another along the fold line 16, sandwiching the return trip flap 14 between them. The two side edge closure flaps 20 are then folded around the exterior surface 12*b* of the back panel 12 and sealed or otherwise adhesively fastened in a conventional manner.

Panel 22 remains extending upwardly from the envelope, although joined to front panel 10 along the fold line 23.

During manufacture, the envelope will also have been printed on the exterior surface. Thus the exterior or outwardly directed surface 10*b* of the front panel 10 will have been printed with the return address of the company, usually in the upper left hand corner in case the piece of mail cannot be delivered. In addition, it will usually have been printed with some form of advertising slogan or other material, and may have been perprinted with a suitable franking mark for the purpose of applying the postage.

The outer surface 12*b* of the back panel 12 may be printed with any suitable directions for use.

The outwardly directed surface 14*b* of the return trip closure flap will of course be concealed within the envelope during the first or outward trip. It will however have been preprinted with the return address of the agency or company using the envelope, so that such address may appear on the exterior of the envelope on the return trip, in the manner to be described below.

In use, the agency or company using the envelope will insert a card 36, usually an invoice card or the like which will have been in most cases preprinted with the name and address of the customer. The card will be inserted between the front panel 10 and the return trip closure panel 14, and will be arranged so that the name and address of the customer appear in the window 30. Alternatively the name and address of the customer may be printed on the exterior of the envelope by any one of a number of suitable addressing systems.

The envelope is then sealed by folding over the first or outward trip closure flap 22 over the exterior surface 12*b* of the back panel 12. The glue strip 24 is then pressure fastened to close the envelope.

At this stage, the envelope will have the appearance as shown in FIGS. 3 and 7.

The extension 33 of panel 32 lies around the card 36 and under the return closure flap 14 (FIG. 7).

After going through the mails, the envelope when it is received by the customer will be opened by unsealing the closure flap 22. The contents, i.e. the card 36, and anything else enclosed in the envelope are then removed. The tear off part of front panel 10, defined by perforation line 35 will then be removed so that such part of panel 10 and flap 22 are separated from the envelope, and are discarded. Such separation will also carry with it the extension 33 and panel 32, such discarded portion being shown in FIG. 9. Extension 33 will itself draw the return trip closure flap 14 out of the envelope, ready for use. The customer will then make out a cheque 38, and may tear off a stub from the invoice card if such a system is used.

The customer can then insert the cheque 38 and the invoice card 36 which will then be sandwiched between the remainder of front panel 10 and back panel 12.

The adhesive or glue strip 28 on the interior face 14*a* of the return trip closure panel 14 is then moistened, and the flap 14 is then folded about the fold line 18 over the exterior surface 10*b* of the front panel 10. The closure flap 14 will be big enough to cover the gap left in the front panel 10, by perforation line 35, and will of course be of sufficient size to cover any fluorescent ink markings or postal frankings which appeared on the exterior surface 10*b* of the front panel 10.

It will of course be appreciated that the action of sealing the closure flap 14*b* over the exterior face 10*b* of the front panel 10 will also mean that the return address, i.e., the address of the company or agency will then appear on the front of the envelope, since it is printed on the surface 14*b* of the panel 14.

The customer will then apply a stamp, or if the envelope is already franked for return mailing, will then simply drop it in the mail. At this stage the envelope will have the appearance substantially as shown in FIGS. 6 and 8.

Various alternatives may be adopted without departing from the scope of the invention.

Various features are of significance in facilitating the various operations by the customer or recipient of the mailing piece, as described above.

Thus for example it will be noted that the dimensions of the return trip closure panel 14 are arranged so as to ensure that it may be easily withdrawn from the interior of the envelope. The return trip closure panel 14 will thus be slightly narrower than the width of the back panel 12 and front panel 10. It will also be slightly tapered along one or both sides. In this way, it will be much easier for the customer to withdraw the panel 14 from the interior of the envelope.

The flaps 20 may be attached to the back panel and glued around the front panel. Alternatively the back and front panels may be joined along one side edge, and sealing flaps would then be provided along the other free side edge of either the back or front panel, and also along the bottom edge of one or other panel.

Where the envelope does not have a window, then the extension flap 33 may be made of any suitable material bonded to the interior of front panel 10.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A machine sortable mailing envelope of the type adapted to be used twice, once on an outward trip, and once on a return trip and adapted for easy machine handling and sorting on both trips, said envelope comprising;

a front panel having an address area for carrying an address;

a back panel;

means joining said front and back panels along their bottom and side edges;

an outward trip closure panel joined to the upper edge of said front panel and adapted to be folded over the upper edge of said back panel and having bonding means;

a return trip closure panel joined to the upper edge of said back panel and folded within the envelope between the back and front panels and having bonding means;

a perforation line extending down either side of said front panel in a generally D-shaped pattern around the address area, defining an upper detachable portion which is removable from the remainder of said front panel, said perforation line being spaced inwardly from the side edges of said front panel to leave marginal strips of said front panel therealong along the bottom and both side edges, said outward trip closure panel being attached to said upper removable portion whereby upon tearing along said perforation line the whole of said outward trip closure panel and said upper central removable portion including said address area may be discarded, said return trip closure panel then being adapted to be withdrawn from the interior of the envelope, and folded over said marginal strips of said front panel and being bonded thereto for the return trip;

interior panel means attached to the interior of said upper central portion, and, an extension flap on said interior panel means folded upwardly between said return trip closure panel and said back panel.

2. A machine sortable mailing envelope as claimed in claim 1 wherein said return trip closure panel means is slightly narrower than said front and back panel means to facilitate its manipulation.

3. A machine sortable mailing envelope as claimed in claim 1 including side edge closing strips on either side of said front panel connected thereto along respective fold lines, and bonding means thereon, for folding around the exterior of said back panel and bonding thereto, said bonding means on said outward and return closure panels, and on said side edge closing strips all being applied on the same face of the envelope blank.

4. A machine sortable mailing envelope as claimed in claim 1 including bonding means on said return trip closure panel located all around the free edges thereof.

5. A machine sortable mailing envelope as claimed in claim 1 wherein said return trip closure panel has a length and breadth sufficient to extend from said upper edge of said back panel over said front panel and cover said central removable portion thereof.

6. A machine sortable mailing envelope as claimed in claim 1 wherein said front panel defines a window opening in said upper detachable portion, wherein said interior panel means comprises a translucent panel covering the same.

7. A machine sortable mailing envelope as claimed in claim 6 wherein said extension flap is formed on said translucent panel and is folded upwardly between said return trip closure panel and said back panel, as aforesaid.

* * * * *